US006949128B2

(12) United States Patent
Annen

(10) Patent No.: US 6,949,128 B2
(45) Date of Patent: Sep. 27, 2005

(54) METHOD OF MAKING AN ABRASIVE PRODUCT

(75) Inventor: Michael J. Annen, Hudson, WI (US)

(73) Assignee: 3M Innovative Properties Company, Saint Paul, MN (US)

( * ) Notice: Subject to any disclaimer, the term of this patent is extended or adjusted under 35 U.S.C. 154(b) by 489 days.

(21) Appl. No.: 10/033,464

(22) Filed: Dec. 28, 2001

(65) Prior Publication Data

US 2003/0150169 A1 Aug. 14, 2003

(51) Int. Cl.[7] ..... B24D 3/00; B24D 11/00; B24D 18/00

(52) U.S. Cl. ..... 51/295; 51/293; 51/298; 51/307; 51/308; 51/309

(58) Field of Search ..... 51/298, 307, 308, 51/309, 293, 295

(56) References Cited

U.S. PATENT DOCUMENTS

| | | | | |
|---|---|---|---|---|
| 1,910,444 | A | | 5/1933 | Nicholson |
| 2,115,897 | A | | 5/1938 | Wooddell et al. |
| 2,242,877 | A | | 5/1941 | Albertson |
| 2,755,607 | A | | 7/1956 | Haywood |
| 3,041,156 | A | | 6/1962 | Rowse et al. |
| 3,048,482 | A | | 8/1962 | Hurst |
| 3,594,865 | A | | 7/1971 | Erb |
| 3,605,349 | A | | 9/1971 | Anthon |
| 4,055,029 | A | | 10/1977 | Kalbow |
| 4,111,666 | A | | 9/1978 | Kalbow |
| 4,255,164 | A | | 3/1981 | Butzke et al. |
| 4,311,489 | A | | 1/1982 | Kressner |
| 4,314,827 | A | | 2/1982 | Leitheiser et al. |
| 4,609,581 | A | | 9/1986 | Ott |
| 4,623,364 | A | | 11/1986 | Cottringer et al. |
| 4,644,703 | A | | 2/1987 | Kaczmarek et al. |
| 4,652,274 | A | | 3/1987 | Boettcher et al. |
| 4,652,275 | A | | 3/1987 | Bloecher et al. |
| 4,735,632 | A | | 4/1988 | Oxman et al. |
| 4,744,802 | A | | 5/1988 | Schwabel |
| 4,751,138 | A | | 6/1988 | Tumey et al. |
| 4,770,671 | A | | 9/1988 | Monroe et al. |
| 4,773,920 | A | | 9/1988 | Chasman et al. |
| 4,799,939 | A | | 1/1989 | Bloecher et al. |
| 4,881,951 | A | | 11/1989 | Wood et al. |
| 4,903,440 | A | | 2/1990 | Larson et al. |
| 4,930,266 | A | | 6/1990 | Calhoun et al. |
| 4,950,696 | A | | 8/1990 | Palazotto et al. |
| 4,959,265 | A | | 9/1990 | Wood et al. |
| 4,985,340 | A | | 1/1991 | Palazzotto et al. |
| 4,997,461 | A | | 3/1991 | Markhoff-Matheny et al. |
| 5,009,675 | A | | 4/1991 | Kunz et al. |
| 5,011,508 | A | | 4/1991 | Wald et al. |
| 5,014,468 | A | | 5/1991 | Ravipati et al. |
| 5,015,266 | A | | 5/1991 | Yamamoto |
| 5,042,991 | A | | 8/1991 | Kunz et al. |
| 5,077,870 | A | | 1/1992 | Melbye et al. |
| 5,085,671 | A | | 2/1992 | Martin et al. |
| 5,107,626 | A | | 4/1992 | Mucci |
| 5,152,917 | A | | 10/1992 | Pieper et al. |
| 5,178,646 | A | | 1/1993 | Barber, Jr. et al. |
| 5,213,591 | A | | 5/1993 | Celikkaya et al. |
| 5,219,462 | A | | 6/1993 | Bruxvoort et al. |
| 5,236,472 | A | | 8/1993 | Kirk et al. |
| 5,254,194 | A | | 10/1993 | Ott et al. |
| 5,256,170 | A | | 10/1993 | Harmer et al. |
| 5,304,223 | A | | 4/1994 | Pieper et al. |
| 5,314,513 | A | | 5/1994 | Miller et al. |
| 5,368,619 | A | | 11/1994 | Culler |
| 5,378,252 | A | | 1/1995 | Follensbee |
| 5,435,816 | A | | 7/1995 | Spurgeon et al. |
| 5,437,754 | A | | 8/1995 | Calhoun |
| 5,454,844 | A | | 10/1995 | Hibbard et al. |
| 5,489,235 | A | | 2/1996 | Gagliardi et al. |
| 5,500,273 | A | | 3/1996 | Holmes et al. |
| 5,505,747 | A | | 4/1996 | Chesley |
| 5,658,184 | A | | 8/1997 | Hoopman et al. |
| 5,667,540 | A | | 9/1997 | Chesley et al. |
| 5,672,097 | A | | 9/1997 | Hoopman |
| 5,672,186 | A | | 9/1997 | Chesley et al. |
| 5,674,122 | A | | 10/1997 | Krech et al. |
| 5,681,217 | A | | 10/1997 | Hoopman et al. |
| 5,692,950 | A | | 12/1997 | Rutherford et al. |
| 5,714,259 | A | | 2/1998 | Holmes et al. |
| 5,849,051 | A | | 12/1998 | Beardsley et al. |
| 5,910,471 | A | | 6/1999 | Christianson et al. |
| 5,975,987 | A | | 11/1999 | Hoopman et al. |
| 6,007,590 | A | | 12/1999 | Sanders, Jr. |
| 6,059,850 | A | * | 5/2000 | Lise et al. ..... 51/297 |
| 6,197,076 | B1 | | 3/2001 | Braunschweig et al. |
| 6,231,629 | B1 | | 5/2001 | Christianson et al. |
| 6,287,184 | B1 | | 9/2001 | Carpentier et al. |
| 6,375,559 | B1 | | 4/2002 | James et al. |
| 6,544,306 | B2 | * | 4/2003 | Suzuki et al. ..... 51/298 |
| 2002/0090901 | A1 | * | 7/2002 | Schutz et al. ..... 451/526 |

FOREIGN PATENT DOCUMENTS

| | | | |
|---|---|---|---|
| GB | 2 094 824 | A | 9/1982 |
| JP | 2083172 | A | 3/1990 |
| JP | HEI 4-159084 | | 6/1992 |
| WO | WO 01/57151 | A2 | 8/2001 |
| WO | WO 02/42034 | A1 | 5/2002 |

* cited by examiner

*Primary Examiner*—Michael Marcheschi
(74) *Attorney, Agent, or Firm*—Richard Francis; Gregory D. Allen

(57) ABSTRACT

The invention provides a method of making an embossed abrasive article comprising providing a sheet-like foam backing having a first surface and an opposite second surface; providing an abrasive coating comprising abrasive particles and binder over said first surface to provide an abrasive article; and applying under pressure a patterned embossing tool having an embossing surface including at least a pattern of raised areas to the abrasive coating of the abrasive article to provide an embossed pattern at least including depressed areas corresponding to the raised areas of the embossing surface in said abrasive coating and said foam backing to provide an embossed abrasive article.

26 Claims, 2 Drawing Sheets

METHOD OF MAKING AN ABRASIVE PRODUCT

FIELD OF THE INVENTION

The present invention relates to a method of making an abrasive product by embossing a foam-backed coated, lapping or three-dimensional abrasive with a patterned embossing tool.

BACKGROUND OF THE INVENTION

In the abrasive industry there is a trend to finer and finer surface finish. Naturally, to achieve these finer surface finishes, smaller sized abrasive particles are employed in the abrasive article. In some instances the particle size of these small sized abrasive particles is less than 50 $\mu$m, typically less than 25 $\mu$m and sometimes less than 10 $\mu$m. In some instances loose abrasive slurries are employed rather than using fixed abrasive articles where the abrasive particles may be bonded together (to provide a bonded abrasive product) or to a backing (to provide a coated abrasive product). Many years ago, these loose abrasive slurries were capable of achieving surface finishes that were not previously obtainable with fixed abrasives. Over the last years, however, advances in fixed abrasives, especially coated abrasives, have enabled coated abrasives to effectively replace loose abrasive slurries in certain applications and thereby avoid the liquid handling equipment required for, and the waste disposal problems associated with, the use of slurries.

In many instances to achieve a fine surface finish, the polishing process is done in the presence of a fluid, typically water or some other type of lubricant. The fluid serves several purposes including minimizing heat build up and serving as a medium to remove the swarf or debris generated during polishing. If the swarf is not effectively removed during polishing, it is possible for the swarf to become re-deposited on the abrasive coating and thereby may cause coarse and undesirable scratches. Thus, it is imperative that the swarf be removed to provide efficient fluid flow at the interface between the abrasive coating and the workpiece surface being polished.

For all of the benefits of the fluid, there are sometimes drawbacks. For instance, with the very small abrasive particles, the resulting outer surface of the abrasive coating may be relatively smooth. The combination of the fluid and smooth abrasive coating has been known to create what is known in the industry as "stiction," whereby the fluid will act like adhesive between the abrasive coating and the workpiece surface to cause these surfaces to stick together with unwanted results.

Stiction typically occurs in lapping type coated abrasive products. There are two common types of coated abrasive products. The first type has the abrasive particles bonded to the backing by means of a make coat. Overlying the abrasive grains is a size coat, which further reinforces the abrasive grains. In this first type, there is essentially one or two layers of abrasive particles. In the fine grades, the abrasive particles are so small that the resulting coated abrasive may exhibit a relatively short life. The second coated abrasive construction has the abrasive particles dispersed, typically uniformly dispersed, in the binder. This second construction is sometimes referred to as a "lapping film." The lapping film may have longer life because there typically are multiple layers of abrasive particles as compared to the construction with the make and size coats. Likewise, the lapping film may produce a finer surface finish because the abrasive particles are more embedded in a binder. Conversely, lapping films tend to have lower cut rates since the first type construction tends to have more abrasive particles protruding.

Stiction tends to occur more frequently with lapping-type construction because the abrasive particles are embedded in the binder to provide a smooth surface. Various lapping type products have been provided with an abrasive coating which is shaped or structured, i.e., having raised portions and recessed portions. These products are sold by Minnesota Mining and Manufacturing (3M) Company under the trade designation "TRIZACT™" abrasive products. They are generally described in U.S. Pat. No. 5,152,917 (Pieper, et al.). Other lapping products are also described in U.S. Pat. No. 5,489,235 (Gagliardi, et al.).

OTHER RELATED ART

U.S. Pat. No. 2,115,897 (Wooddell et al.) teaches an abrasive article having a backing having attached thereto by an adhesive a plurality of bonded abrasive segments. These bonded abrasive segments can be adhesively secured to the backing in a specified pattern.

U.S. Pat. No. 2,242,877 (Albertson) teaches a method of making a compressed abrasive disc. Several layers of coated abrasive fibre discs are placed in a mold and then subjected to heat and pressure to form the compressed center disc. The mold has a specified pattern, which then transfers to the compressed center disc, thus rendering a pattern coated abrasive article.

U.S. Pat. No. 2,755,607 (Haywood) teaches a coated abrasive in which there are lands and grooves of abrasive portions. An adhesive coat is applied to the front surface of a backing and this adhesive coat is then combed to create peaks and valleys. Next abrasive grains are projected into the adhesive followed by solidification of the adhesive coat.

U.S. Pat. No. 3,048,482 (Hurst) discloses an abrasive article comprising a backing, a bond system and abrasive granules that are secured to the backing by the bond system. The abrasive granules are a composite of abrasive grains and a binder which is separate from the bond system. The abrasive granules are three dimensional and are preferably pyramidal in shape. To make this abrasive article, the abrasive granules are first made via a molding process. Next, a backing is placed in a mold, followed by the bond system and the abrasive granules. The mold has patterned cavities therein which result in the abrasive granules having a specified pattern on the backing.

U.S. Pat. No. 3,605,349 (Anthon) pertains to a lapping type abrasive article. Binder and abrasive grain are mixed together and then sprayed onto the backing through a grid. The presence of the grid results in a patterned abrasive coating.

U.S. Pat. No. 4,055,029 (Kalbow) describes an open-cell foam polishing pad having a plurality of protuberances with a scrubbing surface. The protuberances being defined by peripheral surfaces generally perpendicular to, and forming generally sharp edges with, the upper scrubbing surface of the protuberance. The scrubbing surface may further comprise abrasive particles embedded into an adhesive coating on the surface.

U.S. Pat. No. 4,111,666 (Kalbow), a continuation-in-part of U.S. Pat. No. 4,055,029, discloses a polishing pad with an improved scrubbing surface reinforced with absorbed reactive agents such as a two-component polyurethane. The reinforced surface is more rigid than the foam material of the pad.

Great Britain Patent Application No. 2,094,824 (Moore) pertains to a patterned lapping film. The abrasive/binder resin slurry is prepared and the slurry is applied through a mask to form discrete islands. Next, the binder resin is cured. The mask may be a silk screen, stencil, wire or a mesh.

U.S. Pat. Nos. 4,644,703 (Kaczmarek et al.) and 4,773,920 (Chasman et al.) concern a lapping abrasive article comprising a backing and an abrasive coating adhered to the backing. The abrasive coating comprises a suspension of lapping size abrasive grains and a binder cured by free radical polymerization. The abrasive coating can be shaped into a pattern by a rotogravure roll.

U.S. Pat. No. 4,930,266 (Calhoun et al.) teaches a patterned abrasive sheeting in which the abrasive granules are strongly bonded and lie substantially in a plane at a predetermined lateral spacing. In this invention the abrasive granules are applied via an impingement technique so that each granule is essentially individually applied to the abrasive backing. This results in an abrasive sheeting having a precisely controlled spacing of the abrasive granules.

U.S. Pat. No. 5,014,468 (Ravipati et al.) pertains to a lapping film intended for ophthalmic applications. The lapping film comprises a patterned surface coating of abrasive grains dispersed in a radiation cured adhesive binder. To make the patterned surface an abrasive/curable binder slurry is shaped on the surface of a rotogravure roll, the shaped slurry removed from the roll surface and then subjected to radiation energy for curing.

U.S. Pat. No. 5,015,266 (Yamamoto) pertains to an abrasive sheet by uniformly coating an abrasive/adhesive slurry over an embossed sheet to provide an abrasive coating which on curing has high and low abrasive portions formed by the surface tension of the slurry, corresponding to the irregularities of the base sheet.

U.S. Pat. No. 5,107,626 (Mucci) teaches a method of providing a patterned surface on a substrate by abrading with a coated abrasive containing a plurality of precisely shaped abrasive composites. The abrasive composites are in a non-random array and each composite comprises a plurality of abrasive grains dispersed in a binder.

Japanese Patent Application No. 02-083172 (Tsukada et al., published Mar. 23, 1990) teaches a method of a making a lapping film having a specified pattern. An abrasive/binder slurry is coated into indentations in a tool. A backing is then applied over the tool and the binder in the abrasive slurry is cured. Next, the resulting coated abrasive is removed from the tool. The binder can be cured by radiation energy or thermal energy.

Japanese Patent Application No. JP 4-159084 (Nishio et al., published Jun. 2, 1992) teaches a method of making a lapping tape. An abrasive slurry comprising abrasive grains and an electron beam curable resin is applied to the surface of an intaglio roll or indentation plate. Then, the abrasive slurry is exposed to an electron beam which cures the binder and the resulting lapping tape is removed from the roll.

U.S. Pat. No. 5,437,754 (Calhoun), assigned to the same assignee as the present application, teaches a method of making an abrasive article. An abrasive slurry is coated into recesses of an embossed substrate. The resulting construction is laminated to a backing and the binder in the abrasive slurry is cured. The embossed substrate is removed and the abrasive slurry adheres to the backing.

U.S. Pat. No. 5,219,462 (Bruxvoort et al.), assigned to the same assignee as the present application, teaches a method for making an abrasive article. An abrasive/binder/expanding agent slurry is coated substantially only into the recesses of an embossed backing. After coating, the binder is cured and the expanding agent is activated. This causes the slurry to expand above the surface of the embossed backing.

U.S. Pat. No. 5,435,816 (Spurgeon et al.), assigned to the same assignee as the present application, teaches a method of making an abrasive article. In one aspect of this patent, an abrasive/binder slurry is coated into recesses of an embossed substrate. Radiation energy is transmitted through the embossed substrate and into the abrasive slurry to cure the binder.

U.S. Pat. No. 5,658,184 (Hoopman et al.) describes a nail tool. The nail tool comprises a plurality of abrasive composites on a substrate. The substrate is attached to a foam support.

U.S. Pat. No. 5,672,097 (Hoopman), assigned to the same assignee as the present application, teaches an abrasive article where the features are precisely shaped but vary among themselves.

U.S. Pat. No. 5,692,950 (Rutherford et al.) describes an abrasive construction comprising a plurality of three-dimensional composites on a backing. A resilient foam element is adhered to the backing.

U.S. Pat. No. 5,714,259 (Holmes et al.) discloses an abrasive product with precisely shaped abrasive composites. The composites are bonded to a substrate, which may be a polymeric foam.

U.S. Pat. No. 5,910,471 (Christianson et al.) describes an abrasive article comprising a plurality of abrasive composites on a backing, the backing being adhered to a backing pad, which is attached to a foam pad which provides a cushion for the abrasive article during polishing. The backing may also serve as a support pad. For example, the backing may be a foam backing such as a polyurethane foam backing.

What is desired in the industry is a foam-backed abrasive article that minimizes any swarf or debris build up at the abrading interface; quickly generates fine surface finish; has long life; and minimizes stiction.

SUMMARY OF THE INVENTION

The invention provides a method of making an embossed foam-backed abrasive product that overcomes certain of the problems noted above.

Specifically, the invention provides a method of making an embossed abrasive article comprising:

a. providing a sheet-like foam backing having a first surface and an opposite second surface;

b. providing an abrasive coating comprising abrasive particles and binder over said first surface to provide an abrasive article; and c. applying under pressure a patterned embossing tool having an embossing surface including at least a pattern of raised areas to the abrasive coating of the abrasive article to provide an embossed pattern at least including depressed areas corresponding to the raised areas of said embossing surface in said abrasive coating and said foam backing to provide an embossed abrasive article.

The embossing surface may also include depressed areas and thus the embossed item would also include raised areas corresponding to the depressed areas of the embossing surface. The embossed pattern may either be a uniform pattern or a random pattern.

The abrasive coating may be made by utilizing a flowable curable binder make coating into which is deposited abrasive particles such that they are at least partially embedded in the uncured make coating, followed by at least partial curing of the make coating to provide a handleable article which may then optionally be coated with a flowable binder size coating. Thereafter, the coatings are fully cured to provide a coated abrasive article.

The abrasive coating may also be provided by applying a mixture of flowable curable binder and abrasive particles to the first surface and curing the flowable curable binder to provide the abrasive coating. Preferably, the abrasive coating applied in this fashion is contacted with a device having a surface which imparts a pattern to the abrasive coating to provide raised areas and depressed areas in the abrasive coating, but not in the foam backing prior to curing. Thereafter, the patterned or structured abrasive coating is cured in a manner to retain the patterned abrasive surface.

The preferred embossing tool is an embossing roll having a surface which includes appropriately sized depressions and raised portions to produce a desired pattern. Preferably the embossing is such that the depressed areas extend into the foam backing at least about 200 $\mu$m.

The preferred foam backings have a thickness of at least 0.2 mm, preferably the thickness in the range of about 1 mm to about 6 mm. The foam may either be an open cell foam or a closed cell foam.

Embossing typically results in depressions in the foam wherein the distance between the low point in the depression and high point of the distal ends of the raised areas is at least on the order of about 200 micrometers, preferably at least about 500 micrometers.

Any of a variety of embossable foam backings may be employed as the foam backing. A preferred foam backing is a polyethylene foam backing available from Minnesota Mining and Manufacturing Company (3M) under the product designation 4496W.

Useful foam backings will have a thickness on the order of 0.2 to 25 mm, a density on the order of 0.02 to 0.5 g/cm$^3$, and a durometer (Shore 00) preferably on the order of 15 to 100, although foams with a durometor less than 15 may be useful in some applications.

The embossing temperature is very dependent on the type of foam, for example, compression-set foams may be embossed with an embossing tool which need not be heated above ambient temperature. Preferably the embossing tool is heated for other types of foams to facilitate the embossing at a temperature at least about 30° C., preferably heating at a temperature in the range of about 80° C. to about 210° C.

The embossing tool is preferably applied at a pressure in the range of about 1.5 to 200 N/cm of web width, although this may vary, depending on the composition and construction of the foam backing.

DEFINITION OF TERMS

The term "foam" shall refer to both open cell and closed cell foams.

The term "backing" shall mean foam sheet materials.

The term "shaped abrasive coating" shall mean a coating of a cured binder and abrasive material that has an exposed or working surface which includes raised portions and recessed portions.

The term "at least partially cured" shall mean "part" or "all" of the curable precursor material has been cured to such a degree that it is handleable and collectible.

The term "at least partially cured" does not mean that part or all of the curable binder precursor is always fully cured, but it is sufficiently cured, after being at least partially cured, to be handleable and collectible.

As used here, the expression "handleable and collectible" refers to material that will not substantially flow or experience a substantial change in shape if subjected to an applied force that tends to strain or deform a body.

The expression "fully cured" shall mean the binder precursor is sufficiently cured so that the resulting product will function as an abrasive article, e.g. a coated article.

The abrasive product of the present invention has a long and useful life because of the existence of the embossed pattern which provides pre-shaped areas separated by embossed depression lines which provide a collection area for swarf and debris generated during abrading operations with the product. Thus, the abrasive product may include very fine abrasive grains to provide extremely fine surface finishes to any of a variety of working surfaces. The product of the invention provides a viable replacement for utilizing loose abrasive slurries and obviates the need for liquid handling equipment normally associated with slurries and the need for finding appropriate disposal sites for used slurries. The presence of the recessed areas provided by the embossed lines between the pattern of bodies that are coated with abrasive provides for efficient fluid flow at the working face of the abrasive product of the invention without undesirable "stiction" which is normally encountered in smooth-surfaced lapping films on smooth-surfaced work piece surfaces.

DETAILED DESCRIPTION OF THE INVENTION

Figure 1:
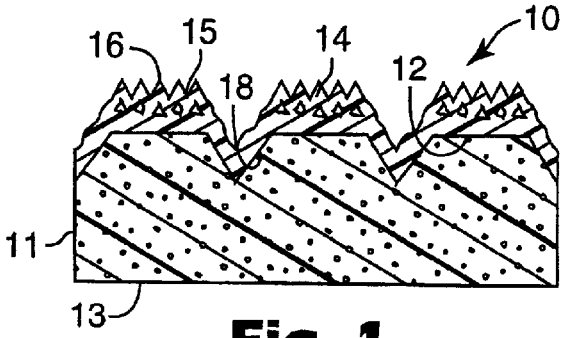
FIG. 1 is an enlarged schematic cross-section drawn representation of a portion of an abrasive product made by use of the method of the present invention.

FIG. 1 shows an enlarged schematic cross-section drawn representation of a portion of an abrasive product 10 made by the method of the present invention. Abrasive product 10 includes foam backing 11 having a first surface 12 and an opposite surface 13. Prior to embossing, an abrasive coating is provided on the first surface 12.

The abrasive coating may either be made with a make coating which includes partially embedded abrasive particles which coating and particles are preferably overcoated with a size coating, or an abrasive composite wherein abrasive particles are uniformly dispersed in a cured binder. The abrasive coating 14 depicted in FIG. 1 is made by applying a mixture of abrasive particles and curable binder to a backing surface 12, and before curing, applying a surface of a production tool to the uncured coating to impart a textured finish including depressed areas 15 and raised areas 16 to provide a structured abrasive surface.

Figure 3:
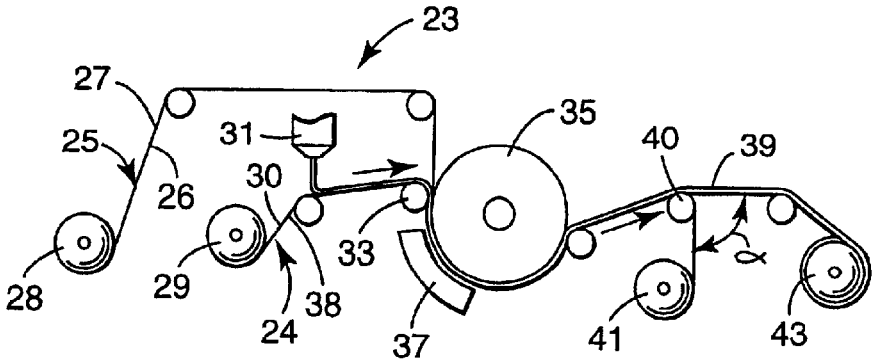
FIG. 3 is a schematic representation of one method for making an abrasive article which may be embossed according to the method of the present invention.

The manufacture of this type of product may be accomplished by utilization of the equipment schematically shown in FIG. 3. FIG. 3 illustrates an apparatus 23 for applying a shaped coating to the first major surface of the foam backing 25. A production tool 24 is in the form of belt having a cavity-bearing contacting surface 30, opposite backing surface 38, and appropriately sized cavities within contacting surface 30. Backing 25 having a first major surface 26 and a second major surface 27 is unwound from roll 28. At the same time backing 25 is unwound from roll 28, the production tool 24 is unwound from roll 29. The contacting surface 30 of production tool 24 is coated with a mixture of abrasive particles and binder precursor at coating station 31. The mixture may be heated to lower the viscosity prior to or during the coating step. The coating station can comprise any conventional coating means, such as knife coater, drop die coater, curtain coater, vacuum die coater, or an extrusion die coater. After contacting surface 30 of production tool 24 is coated, the backing 25 and the production tool 24 are brought together such that the mixture wets the first major surface 26 of the backing 25. In FIG. 3 the mixture is forced into contact with the backing 25 by means of a contact nip roll 33, which also forces the production tool/mixture/backing construction against a support drum 35. Next, a sufficient dose of radiation energy is transmitted by a source of radiation energy 37 through the back surface 38 of production tool 24 and into the mixture to at least partially cure the binder precursor, thereby forming a shaped, handleable structure 39. The production tool 24 is then separated from the shaped, handleable structure 39. Separation of the production tool 24 from the shaped, handleable structure 39 occurs at roller 40. The angle, alpha, between the shaped, handleable structure 39 and the production tool 24 immediately after passing over roller 40 is preferably a steep angle, e.g., in excess of 30 degrees, in order to bring about clean separation of the shaped, handleable structure 39 from the production tool 24. The production tool 24 is rewound as roll 41 so that it can be reused. The shaped, handleable structure 39 is wound as roll 43. If the binder precursor has not been fully cured, it can then be fully cured by exposure to an additional energy source, such as a source of thermal energy or an additional source of radiation energy, to form the coated abrasive article. Alternatively, full cure may eventually result without the use of an additional energy source to form the coated abrasive article. As used herein, the phrase "full cure" means that the binder precursor is sufficiently cured so that the resulting product will function as an abrasive article, e.g., a coated abrasive article.

Figure 2:
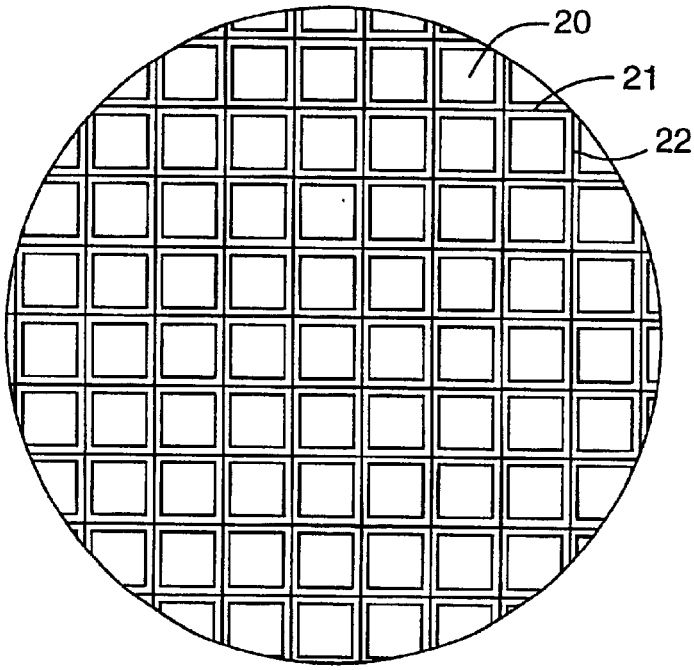
FIG. 2 is a top plane view of an embossed abrasive disc made by utilization of the method of the present invention.
Figure 7:
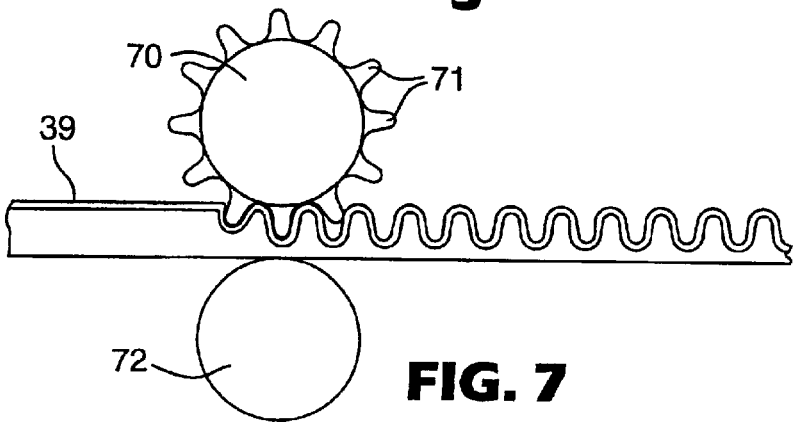
FIG. 7 is a schematic representation of one method of making the embossed abrasive article according to the present invention.

The cured foam-backed abrasive article made by use of the equipment depicted in FIG. 3 has a relatively smooth surface except for the surface undulations imparted by the production tool 24. As shown in FIG. 7, the surface of the abrasive article 39 is then subjected to contact with an embossing tool in the form of a patterned embossing roll 70 which has raised areas 71. Roll 70 is deployed adjacent smooth unheated backup roll 72 such that raised areas 71 on embossing roll 70 impart an embossed pattern in the abrasive coating and into the foam backing which extends into the foam backing preferably at least 200 $\mu$m. The embossed lines, as depicted in FIG. 2, define abrasive islands which are characterized by machine direction embossed lines 21 and transverse embossed lines 22 to create depressions 18, as depicted in FIG. 1.

The components of the abrasive product which is embossed in accordance with the method of the present invention are herein described.

Abrasive Particles

An abrasive article of the present invention typically comprises at least one abrasive composite layer that includes a plurality of abrasive particles dispersed in precursor polymer subunits. The binder is formed from a binder precursor comprising precursor polymer subunits. The abrasive particles may be uniformly dispersed in a binder or alternatively the abrasive particles may be non-uniformly dispersed therein. It is preferred that the abrasive particles are uniformly dispersed in the binder so that the resulting abrasive article has a more consistent cutting ability.

The average particle size of the abrasive particles can range from about 0.01 to 1500 micrometers, typically between 0.01 and 500 micrometers, and most generally between 1 and 100 micrometers. The size of the abrasive particle is typically specified to be the longest dimension of the abrasive particle. In most cases there will be a range distribution of particle sizes. In some instances it is preferred that the particle size distribution be tightly controlled such that the resulting abrasive article provides a consistent surface finish on the workpiece being abraded.

Examples of conventional hard abrasive particles include fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel abrasive particles and the like. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), all incorporated hereinafter by reference.

The term abrasive particle, as used herein, also encompasses single abrasive particles bonded together with a polymer to form an abrasive agglomerate. Abrasive agglomerates are further described in U.S. Pat. No. 4,311,489 (Kressner); U.S. Pat. No. 4,652,275 (Bloecher et al.); U.S. Pat. No. 4,799,939 (Bloecher et al.), and U.S. Pat. No. 5,500,273 (Holmes et al.). Alternatively, the abrasive particles may be bonded together by inter particle attractive forces.

The abrasive particle may also have a shape associated with it. Examples of such shapes include rods, triangles, pyramids, cones, solid spheres, hollow spheres and the like. Alternatively, the abrasive particle may be randomly shaped.

Abrasive particles can be coated with materials to provide the particles with desired characteristics. For example, materials applied to the surface of an abrasive particle have been shown to improve thc adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 4,997,461

(Markhoff-Matheny et al.); U.S. Pat. No. 5,213,591 (Celikkaya et al.); U.S. Pat. No. 5,085,671 (Martin et al.) and U.S. Pat. No. 5,042,991 (Kunz et al.), the disclosures of which are incorporated herein by reference.

Fillers

An abrasive article of this invention may comprise an abrasive coating which further comprises a filler. A filler is a particulate material with an average particle size range between 0.1 to 50 micrometers, typically between 1 to 30 micrometers. Examples of useful fillers for this invention include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, aluminum trihydrate, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides and suspending agents.

An example of a suspending agent is an amorphous silica particle having a surface area less than 150 meters square/gram that is commercially available from DeGussa Corp., Rheinfelden, Germany, under the trade name "OX-50." The addition of the suspending agent can lower the overall viscosity of the abrasive slurry. The use of suspending agents is further described in U.S. Pat. No. 5,368,619 (Culler) incorporated hereinafter by reference.

Abrasive Composite Binders

The abrasive coating of this invention is formed from a curable abrasive composite layer that comprises a mixture of abrasive particles and precursor polymer subunits. The curable abrasive composite layer preferably comprises organic precursor polymer subunits. The precursor polymer subunits preferably are capable of flowing sufficiently so as to be able to coat a surface. Solidification of the precursor polymer subunits may be achieved by curing (e.g., polymerization and/or cross-linking), by drying (e.g., driving off a liquid) and/or simply by cooling. The precursor polymer subunits may be an organic solvent-borne, a water-borne, or a 100% solids (i.e., a substantially solvent-free) composition. Both thermoplastic and/or thermosetting polymers, or materials, as well as combinations thereof, maybe used as precursor polymer subunits. Upon the curing of the precursor polymer subunits, the curable abrasive composite is converted into the cured abrasive composite. The preferred precursor polymer subunits can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

An abrasive composite layer may comprise by weight between about 1 part abrasive particles to 90 parts abrasive particles and 10 parts precursor polymer subunits to 99 parts precursor polymer subunits. Preferably, an abrasive composite layer may comprise about 30 to 85 parts abrasive particles and about 15 to 70 parts precursor polymer subunits. More preferably an abrasive composite layer may comprise about 40 to 70 parts abrasive particles and about 30 to 60 parts precursor polymer subunits.

The precursor polymer subunits are preferably a curable organic material (i.e., a polymer subunit or material capable of polymerizing and/or crosslinking upon exposure to heat and/or other sources of energy, such as electron beam, ultraviolet light, visible light, etc., or with time upon the addition of a chemical catalyst, moisture, or other agent which cause the polymer to cure or polymerize). Precursor polymer subunits examples include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast precursor polymer subunits have at least one pendant alpha, beta-unsaturated carbonyl group per molecule or oligomer. These polymer materials are further described in U.S. Pat. No. 4,903,440 (Larson et al.) and U.S. Pat. No. 5,236,472 (Kirk et al.), both incorporated herein by reference.

Preferred cured abrasive coatings are generated from free radical curable precursor polymer subunits. These precursor polymer subunits are capable of polymerizing rapidly upon an exposure to thermal energy and/or radiation energy. One preferred subset of free radical curable precursor polymer subunits include ethylenically unsaturated precursor polymer subunits. Examples of such ethylenically unsaturated precursor polymer subunits include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof The term acrylate includes both acrylates and methacrylates.

Ethylenically unsaturated precursor polymer subunits include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers. Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobomyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2-(2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, or N-vinylpiperidone.

A preferred precursor polymer subunits contains a blend of two or more acrylate monomers. For example, the precursor polymer subunits may be a blend of trifunctional acrylate and monofunctional acrylate monomers. An example of one precursor polymer subunits is a blend of propoxylated trimethylol propane triacrylate and 2-(2-ethoxyethoxy) ethyl acrylate. The weight ratios of multifunctional acrylate and monofunctional acrylate polymers may range from about 1 part to about 90 parts multifunctional acrylate to about 10 parts to about 99 parts monofunctional acrylate.

It is also feasible to formulate a precursor polymer subunits from a mixture of an acrylate and an epoxy polymer, e.g., as described in U.S. Pat. No. 4,751,138 (Tumey et al.), incorporated herein by reference.

Other precursor polymer subunits include isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris (hydroxyethyl) isocyanurate.

Still other precursor polymer subunits include diacrylate urethane esters as well as polyacrylate or poly methacrylate urethane esters of hydroxy terminated isocyanate extended polyesters or polyethers. Examples of commercially available acrylated urethanes include those under the tradename "UVITHANE 782," available from Morton Chemical, Moss Point, Miss.; "CMD 6600," "CMD 8400," and "CMD 8805," available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other precursor polymer subunits include diacrylate epoxy esters as well as polyacrylate or polymethacrylate epoxy ester such as the diacrylate esters of bisphenol A epoxy polymer. Examples of commercially available acrylated epoxies include those under the tradename "CMD 3500," "CMD 3600," and "CMD 3700," available from UCB Radcure Specialties.

Other precursor polymer subunits may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred precursor polymer subunits is a blend of ethylenically unsaturated oligomer and monomers. For example the precursor polymer subunits may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof.

The precursor polymer subunits may also be an acrylate dispersion like that described in U.S. Pat. No. 5,378,252 (Follensbee), incorporated herein by reference.

In addition to thermosetting polymers, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof.

Water-soluble precursor polymer subunits optionally blended with a thermosetting resin may be used. Examples of water-soluble precursor polymer subunits include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.), incorporated herein by reference.

Make and Size Coat Binders

The binder used in the coated abrasive, such as a make, size or supersize coat, generally will be formed from a resinous binder or adhesive. The resinous adhesive generally will be selected such that it has the suitable properties necessary for an abrasive article binder. Examples of typical resinous adhesives useful in this invention include thermosetting resins, such as phenolic resins, aminoplast resins having pendant $\alpha$, $\beta$-unsaturated carbonyl groups, urethane resins, epoxy resins, ethylenically-unsaturated resins, acrylated isocyanurate resins, urea-formaldehyde resins, isocyanurate resins, acrylated urethane resins, acrylated epoxy resins, bismaleimide resins, fluorene modified epoxy resins, and mixtures thereof Epoxy resins useful as binders have an oxirane ring and are polymerized by the ring opening. Such epoxide resins include monomeric epoxy resins and polymeric epoxy resins. These resins may vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)phenyl]propane (diglycidyl ether of bisphenol) and resins which are commercially available from Shell Chemical Co., Houston, Tex., under the trade designations "EPON 828", "EPON 1004", and "EPON 1001 F"; and from Dow Chemical Co., Midland, Mich., under the trade designations "DER 331", "DER 332", and "DER 334". Aqueous emulsions of the diglycidyl ether of bisphenol A have from about 50 to 90 wt. % solids, preferably 50 to 70 wt. % solids, and further comprise a nonionic emulsifier. An emulsion meeting this description is available from Shell Chemical Co., Louisville, Ky., under the trade designation "CMD 35201". Other suitable epoxy resins include glycidyl ethers of phenol formaldehyde novolac (which are available from Dow Chemical Co., Midland, Mich., under the trade designations "DEN 431" and "DEN 438").

Phenolic resins are widely used in abrasive article binders because of their thermal properties, availability, cost and ease of handling. There are two types of phenolic resins, resole and novolac, and they can be used in this invention. Resole phenolic resins have a molar ratio of formaldehyde to phenol, of greater than or equal to 1:1, typically between 1.5:1.0 to 3.0:1.0. Novolac resins have a molar ratio of formaldehyde to phenol of less than one to one. Examples of phenolic resins include those commercially available from Occidental Chemical Corp., Tonawanda, N.Y., under the trade designations "DUREZ" and "VARCUM"; from Monsanto Co., St. Louis, Mo., under the trade designation "RESINOX"; and from Ashland Chemical Inc., Columbus, Ohio, under the trade designations "AROFENE" and "AROTAP".

The aminoplast resins which can be used as binders have at least one pendant α, β-unsaturated carbonyl group per molecule or oligomer. These materials are further described in U.S. Pat. Nos. 4,903,440 and 5, 236,472, of which descriptions are both incorporated herein by reference.

Ethylenically-unsaturated resins which can be used in this invention include both monomeric and polymeric compounds that contain atoms of carbon, hydrogen and oxygen, and optionally, nitrogen and the halogens. Oxygen or nitrogen atoms is or both are generally present in ether, ester, urethane, amide, and urea groups. The ethylenically-unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, malcic acid, and the like. Representative examples of ethylenically-unsaturated resins include those made by polymerizing methyl methacrylate, ethyl methacrylate, styrene, divinylbenzene, vinyl toluene, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate, or pentaerythritol tetramethacrylate, and mixtures thereof. Other ethylenically-unsaturated resins include those of polymerized monoallyl, polyallyl, and polymethallyl esters and amides of carboxylic acids, such as diallyl phthalate, diallyl adipate, and N,N-diallyladipamide. Still other polymerizable nitrogen-containing compounds include tris(2-acryloxyethyl)isocyanurate, 1,3,5-tri(2-methacryloxyethyl)-s-triazine, acrylamide, methylacrylamide, N-methylacrylamide, N, N-dimethyl-acrylamide, N-vinylpyrrolidone, and N-vinylpiperidone.

Acrylated urethanes are diacrylate esters of hydroxy terminated isocyanate extended polyesters or polyethers. Examples of acrylated urethanes which can be used in the make coats of the present invention include those commercially available from Radcure Specialties, Inc., Atlanta, Ga., under the trade designations, "UVITHANE 782", "CMD 6600", "CMD 8400", and "CMD 8805". Acrylated epoxies which can be used in the make coats are diacrylate esters of epoxy resins, such as the diacrylate esters of bisphenol A epoxy resin. Examples of acrylated epoxies include those available from Radcure Specialties, Inc., Atlanta, Ga., under the trade designations, "CMD 3500", "CMD 3600", and "CMD 3700".

Bismaleimide resins which also can be used as binder are further described in U.S. Pat. No. 5,314,513 (Miller et al.), which description is incorporated herein by reference.

Initiators

In the case of precursor polymer subunits containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof. Examples of suitable commercially available, ultraviolet-activated photoinitiator have tradenames such as "IRGACURE 651," "IRGACURE 184," and "DAROCUR 1173 " commercially available from Ciba Specialty Chemicals, Tarrytown. N.Y., Another visible light-activated photoinitiator has the trade name "IRGACURE 369 " commercially available from Ciba Geigy Company. Examples of suitable visible light-activated initiators are reported in U.S. Pat. No. 4,735,632 (Oxman et al.) and U.S. Pat. No. 5,674,122 Krech et al.).

A suitable initiator system may include a photosensitizer. Representative photosensitizers may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX," "QUANTICURE QTX," "QUANTICURE PTX," "QUANTICURE EPD" from Biddle Sawyer Corp., New York, N.Y.

In general, the amount of photosensitizer or photoinitiator system may vary from about 0.01 to 10% by weight, more preferably from 0.25 to 4.0% by weight of the components of the precursor polymer subunits.

Additionally, it is preferred to disperse (preferably uniformly) the initiator in the precursor polymer subunits before addition of any particulate material, such as the abrasive particles and/or filler particles.

In general, it is preferred that the precursor polymer subunits be exposed to radiation energy, preferably ultraviolet light or visible light, to cure or polymerize the precursor polymer subunits. In some instances, certain abrasive particles and/or certain additives will absorb ultraviolet and visible light, which may hinder proper cure of the precursor polymer subunits. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyldiphenylphosphine oxide, which is commercially available from BASF Corporation, Ludwigshafen, Germany, under the trade designation "LUCIRIN TPO-L." Other examples of commercially available acylphosphine oxides include "DAROCUR 4263" and "DAROCUR 4265" commercially available from Ciba Specialty Chemicals.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. No. 4,751,138 (Tumey et al.); U.S. Pat. No. 5,256,170 (Harmer et al.); U.S. Pat. No. 4,985,340 (Palazotto); and U.S. Pat. No. 4,950,696, all incorporated herein by reference.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

Backing

The backing may be any of a variety of resilient foam sheet materials that are suitable for the abrasive article made in accordance with the method of the present invention. Examples include open cell foams, closed cell foams and combinations thereof. Useful reinforced foam substrates may have essentially no web-direction or cross-web elongation when reinforced, for example, with a scrim, or other support, such as a woven or nonwoven material. Unreinforced foam substrates may have an elongation (i.e., the elongation is the stretched length of the foam minus the unstretched length of the foam divided by the unstretched length of the foam and then multiplied by 100) up to 150% or greater. The thickness of the foam backing may range from about 0.2 to 25 mm, and preferably between 1 and 6 mm.

The materials generally found to be useful to be made into open- or closed-cell foams are organic polymers that are foamed or blown to produce porous organic structures, which are typically referred to as foams. Such foams may be prepared from natural or synthetic rubber or other thermoplastic elastomers such as polyolefins, polyesters, polyamides, polyurethanes, and copolymers thereof, for example. Suitable synthetic thermoplastic elastomers include, but are not limited to, chloroprene rubbers, crosslinked polyolefins, ethylene/propylene rubbers, butyl rubbers, polybutadienes, polyisoprenes, EPDM polymers, polyvinyl chlorides, polychloroprenes, or styrene/butadiene copolymers. Examples of useful closed-cell foams are polyethylene foams, commercially available from 3M Company, St. Paul, Minn., under the trade designation 4496W. Examples of useful open cell foams are polyester polyurethane foams, commercially available from Illbruck, Inc., Minneapolis, Minn. under the trade designations R 200U, R 400U, R 600U and EF3-700C.

The backing may be laminated to other sheet materials, for example, for reinforcement, or to apply one part of a two-part attachment system. For example, a reinforcing fabric may be applied to the surface 13 of the backing to provide tear resistance to the abrasive product. Additionally, one part of a two-part mechanical attachment system may be applied to a surface 13 such as a loop fabric having engaging loops on its surface for attachment for either hooks contained on the surface to which it is to be attached, or stems having flattened distal ends which likewise may be contained on the surface to which the abrasive product is to be applied. Additional information on suitable loop fabrics may be round in U.S. Patent No. 4,609,581 (Ott) and U.S. Pat. No. 5,254,194 (Ott), both being incorporated herein by reference. Alternatively, the backing may be a sheet-like structure having engaging hooks protruding from the opposite second major surface. Examples of such sheet like structures with engaging hooks may be found in U.S. Patent No., 5,505,747 (Chasley), U.S. Pat. No. 5,667,540 (Chesley), U.S. Pat. No. 5,672,186 (Chesley), and U.S. Pat. No. 6,197,076 (Braunschweig), all being incorporated herein by reference.

Barrier Coating

In some cases it may be desirable to barrier-coat the foam prior to coating with an abrasive layer. Preferred barrier coating compositions comprise a suitable coatable material such as a polymer dissolved or dispersed as a latex, for example, in a suitable liquid carrier material such as a solvent. Such compositions preferably are easily coated onto one major surface of the foam substrate and, once coated, cured to provide a foraminous coating or a nonforaminous barrier coating. Suitable materials for forming the barrier coating are acrylic latex emulsions. A preferred composition for forming the barrier coating is an acrylic emulsion available from BF Goodrich, Cleveland, Ohio under the trade designation "HYCAR" 2679 latex. The dry coating weight of barrier coating applied to the foam preferably is at least 50 grams per square meter (gsm) and typically may vary between 65 gsm and 250 gsm. The acrylic latex emulsion can also be thickened prior to coating the foam surface. The acrylic emulsion may be thickened by the addition of a thickening agent such as solution of a polyacrylic acid available under the trade designation "CARBOPOL" EZ-1 from BF Goodrich which has been thickened by the addition of an aqueous ammonium hydroxide solution which serves as an activator for the "CARBOPOL" EZ-1 polyacrylic acid solution. Coating techniques amenable to barrier-coating the foam substrate include roll coating, spray coating and curtain coating. Curing of the barrier coating composition can be done, e.g., in a forced air oven heated at the curing temperature of the barrier coating composition to provide the coated backing bearing a barrier coating.

The Embossed Product

As shown in FIG. 2, the embossed product is characterized by including emboss line-separated structures or islands 20 having distal ends covered with abrasive.

As shown in FIG. 1, the height of the island produced by embossing measured from the lowest point in depression 18 within the embossed foam to the original surface 12 of the foam will be characterized as the height of the raised portion on the foam. This height may range from about 0.2 mm to about 20 mm, typically from about 0.25 mm to about 10 mm, and preferably about 0.3 mm to about 5 mm. The height of the abrasive coating raised portions may range from about 5 micrometers to about 1000 micrometers, typically about 25 micrometers to about 500 micrometers, and preferably from about 25 micrometers to about 250 micrometers.

The embossed pattern in the surface of the abrasive coated foam may take any of a variety of shapes including random shapes or uniform patterns. The embossed pattern may be a hexagonal array, a rectangular array, a square array, or it may have depressed areas which leave raised areas of a circular configuration.

An Abrasive Composite Layer

An abrasive composite layer of the embossed foam-backed product of this invention typically comprises a plurality of abrasive particles fixed and dispersed in cured precursor polymer subunits, but may include other additives such as coupling agents, fillers, expanding agents, fibers, antistatic agents, initiators, suspending agents, photosensitizers, lubricants, wetting agents, surfactants, pigments, dyes, UV stabilizers and suspending agents. The amounts of these additives are selected to provide the properties desired.

The abrasive composite may optionally include a plasticizer. In general, the addition of the plasticizer will increase the erodibility of the abrasive composite and soften the overall binder composition. In some instances, the plasticizer will act as a diluent for the precursor polymer subunits. The plasticizer is preferably compatible with the precursor polymer subunits to minimize phase separation. Examples of suitable plasticizers include polyethylene glycol, polyvinyl chloride, dibutyl phthalate, alkyl benzyl phthalate, polyvinyl acetate, polyvinyl alcohol, cellulose esters, silicone oils, adipate and sebacate esters, polyols, polyols derivatives, t-butylphenyl diphenyl phosphate, tricresyl phosphate, castor oil, or combinations thereof Phthalate derivatives are one type of preferred plasticizers.

The abrasive particle, or abrasive coating, may further comprise surface modification additives include wetting agents (also sometimes referred to as surfactants) and coupling agents. A coupling agent can provide an association bridge between the precursor polymer subunits and the abrasive particles. Additionally, the coupling agent can provide an association bridge between the binder and the filler particles. Examples of coupling agents include silanes, titanates, and zircoaluminates.

In addition, water and/or organic solvent may be incorporated into the abrasive composite. The amount of water and/or organic solvent is selected to achieve the desired coating viscosity of precursor polymer subunits and abrasive particles. In general, the water and/or organic solvent should be compatible with the precursor polymer subunits. The water and/or solvent may be removed following polymerization of the precursor, or it may remain with the abrasive composite. Suitable water soluble and/or water sensitive additives include polyvinyl alcohol, polyvinyl acetate, or cellulosic based particles.

Examples of ethylenically unsaturated diluents or monomers can be found in U.S. Pat. No. 5,236,472 (Kirk et al.), incorporated herein by reference. In some instances these ethylenically unsaturated diluents are useful because they tend to be compatible with water. Additional reactive diluents are disclosed in U.S. Pat. No. 5,178,646 (Barber et al.), incorporated herein by reference.

Abrasive Composite Structure Configuration

An abrasive article of this invention contains an abrasive coating with at least one abrasive composite layer that includes plurality of shaped, preferably precisely shaped, abrasive composite structures. The term "shaped" in combination with the term "abrasive composite structure" refers to both "precisely shaped" and "irregularly shaped" abrasive composite structures. An abrasive article of this invention may contain a plurality of such shaped abrasive composite structures in a predetermined array on a backing. The shaped abrasive composites may be in a random or irregular placement on the backing. An abrasive composite structure can be formed, for example, by curing the precursor polymer subunits while being borne on the backing and in the cavities of the production tool.

The shape of the abrasive composites structures may be any of a variety of geometric configurations. Typically the base of the shape in contact with the backing has a larger surface area than the distal end of the composite structure. The shape of the abrasive composite structure may be selected from among a number of geometric solids such as a cubic, cylindrical, prismatic, parallelepiped, pyramidal, truncated pyramidal, conical, hemispherical, truncated conical, or posts having any cross section. Generally, shaped composites having a pyramidal structure have three, four, five or six sides, not including the base. The cross-sectional shape of the abrasive composite structure at the base may differ from the cross-sectional shape at the distal end. The transition between these shapes may be smooth and continuous or may occur in discrete steps. The abrasive composite structures may also have a mixture of different shapes. The abrasive composite structures may be arranged in rows, spiral, helix, or lattice fashion, or may be randomly placed.

The sides forming the abrasive composite structures may be perpendicular relative to the backing, tilted relative to the backing or tapered with diminishing width toward the distal end. An abrasive composite structure with a cross section that is larger at the distal end than at the back may also be used, although fabrication may be more difficult.

The height of each abrasive composite structure is preferably the same, but it is possible to have composite structures of varying heights in a single fixed abrasive article. The height of the composite structures generally may be less than about 2000 micrometers, and more particularly in the range of about 25 to 1000 micrometers. The diameter or cross sectional width of the abrasive composite structure can range from about 5 to 500 micrometers, and typically between about 10 to 250 micrometers.

The base of the abrasive composite structures may abut one another or, alternatively, the bases of adjacent abrasive composites may be separated from one another by some specified distance.

The linear spacing of the abrasive composite structures may range from about 1 to 24,000 composites/cm$^2$ and preferably at least about 50 to 15,000 abrasive composite structures/cm$^2$. The linear spacing may be varied such that the concentration of composite structures is greater in one location than in another. The area spacing of composite structures ranges from about 1 abrasive composite structure per linear cm to about 100 abrasive composite structures per linear cm and preferably between about 5 abrasive composite structures per linear cm to about 80 abrasive composites per linear cm.

The percentage bearing area may range from about 5 to about 95%, typically about 10% to about 80%, preferably about 25% to about 75% and more preferably about 30% to about 70%. The bearing area is the total area of the surfaces at the distal ends of the islands. The percent bearing area is the bearing area divided by the total area of the backing times 100.

The shaped abrasive composite structures are preferably set out on a backing, or a previously cured abrasive composite layer, in a predetermined pattern. Generally, the predetermined pattern of the abrasive composite structures will correspond to the pattern of the cavities on the production tool. The pattern is thus reproducible from article to article.

In one embodiment, an abrasive article of the present invention may contain abrasive composite structures in an array. With respect to a single abrasive composite layer, a regular array refers to aligned rows and columns of abrasive composite structures. In another embodiment, the abrasive composite structures may be set out in a "random" array or pattern. By this it is meant that the abrasive composite structures are not aligned in specific rows and columns. For example, the abrasive composite structures may be set out in a manner as described in U.S. Pat. No. 5,681,217 (Hoopman et al.). It is understood, however, that this "random" array is a predetermined pattern in that the location of the composites is predetermined and corresponds to the location of the cavities in the production tool used to make the abrasive article. The term "array" refers to both "random" and "regular" arrays.

Production Tool

Figure 4:
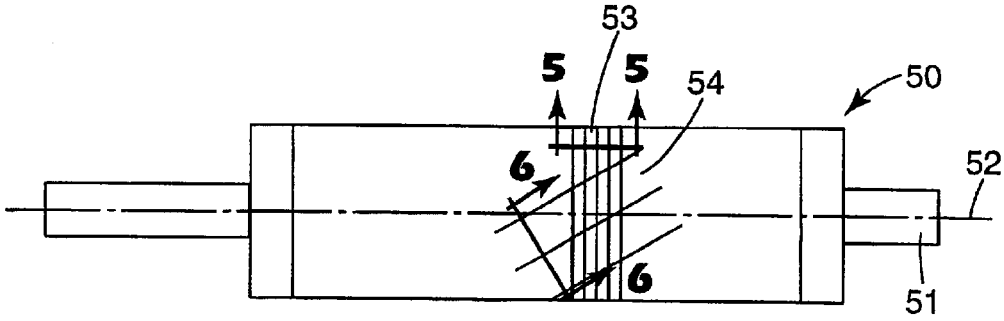
FIG. 4 is a top plane view of a roller for making a production tool useful for making an abrasive article which may be embossed according to the method of the present invention.

FIG. 4 shows a roller that was used to make production tool 24 as depicted in FIG. 3. The following specific embodiment of roller 50 was used to make production tool 24 which was then used to make the abrasive composite structure of the present invention. Roller 50 has a shaft 51 and an axis of rotation 52. In this case the patterned surface includes a first set 53 of adjacent circumferential grooves around the roller and a second set 54 of equally spaced grooves deployed at an angle of 30° with respect to the axis of rotation 52.

Figure 5:
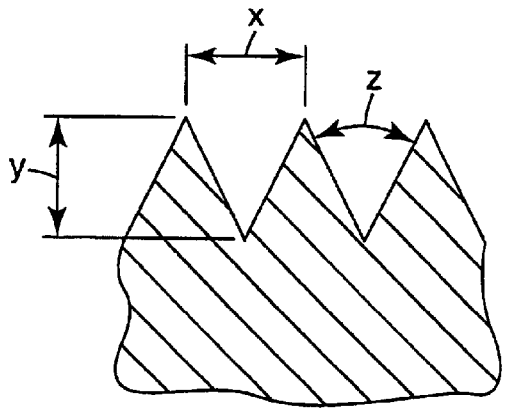
FIG. 5 is an enlarged sectional view of one segment of the roll depicted in FIG. 4 taken at line 5—5 to show surface detail.

FIG. 5 shows an enlarged cross sectional view of a segment of the patterned surface of roller 50 taken at line 5—5 in FIG. 5 perpendicular to the grooves in set 53. FIG. 5 shows the patterned surface has peaks spaced by distance x which is 54.8 $\mu$m apart peak to peak and a peak height, y, from valley to peak of 55 $\mu$m, with an angle z which is 53°.

Figure 6:
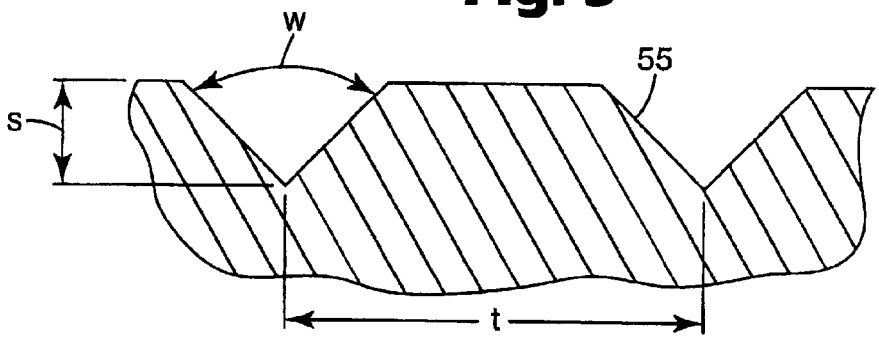
FIG. 6 is an enlarged sectional view of another segment of the patterned surface of the roll depicted in FIG. 4, taken at line 6—6.

FIG. 6 shows an enlarged cross sectional view of a segment of the patterned surface of roller 50 taken at line 6—6 in FIG. 5 perpendicular to the grooves in set 54. FIG. 6 shows grooves 55 having an angle w which is a 99.5° angle between adjacent peak slopes and valleys separated by a distance t which is 250 $\mu$m and a valley depth s which is 55 $\mu$m.

A production tool is used to provide an abrasive composite layer with an array of either precisely or irregularly shaped abrasive composite structures. A production tool has a surface containing a plurality of cavities. These cavities are essentially the inverse shape of the abrasive composite structures and are responsible for generating the shape and placement of the abrasive composite structures. These cavities may have any geometric shape that is the inverse shape to the geometric shapes suitable for the abrasive composites. Preferably, the shape of the cavities is selected such that the surface area of the abrasive composite structure decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as photolithography, knurling, engraving, hobbing, electroforming, diamond turning, and the like. Preferred methods of making metal master tools are described in U.S. Pat. No. 5,975,987 (Hoopman et al.).

A thermoplastic tool can be replicated off a metal master tool. The master tool will have the inverse pattern desired for the production tool. The master tool is preferably made out of metal,. e.g., a nickel-plated metal such as aluminum, copper or bronze. A thermoplastic sheet material optionally can be heated along with the master tool such that the thermoplastic material is embossed with the master tool pattern by pressing the two together. The thermoplastic material can also be extruded or cast onto the master tool and then pressed. The thermoplastic material is cooled to a nonflowable state and then separated from the master tool to produce a production tool. The production tool may also contain a release coating to permit easier release of the abrasive article from the production tool. Examples of such release coatings include silicones and fluorochemicals.

Suitable thermoplastic production tools are reported in U.S. Pat. No. 5,435,816 (Spurgeon et al.), incorporated herein by reference. Examples of thermoplastic materials useful to form the production tool include polyesters, polypropylene, polyethylene, polyamides, polyurethanes, polycarbonates, or combinations thereof It is preferred that the thermoplastic production tool contain additives such as anti-oxidants and/or UV stabilizers. These additives may extend the useful life of the production tool.

Method for Making an Abrasive Article

There are a number of methods to make the abrasive article of this invention. In one aspect the abrasive coating comprises a plurality of precisely shaped abrasive composites. In another aspect the abrasive coating comprises non-precisely shaped abrasive composites, sometimes referred to as irregularly shaped abrasive composites. A preferred method for making an abrasive article with one abrasive composite layer having precisely shaped abrasive composite structures is described in U.S. Pat. No. 5,152,917 (Pieper et al) and U.S. Pat. No. 5,435,816 (Spurgeon et al.), both incorporated herein by reference. Other descriptions of suitable methods are reported in U.S. Pat. No. 5,454,844 (Hibbard et al.); U.S. Pat. No. 5,437,754 (Calhoun); and U.S. Pat. No. 5,304,223 (Pieper et al.), all incorporated herein by reference.

A suitable method for preparing an abrasive composite layer having a plurality of shaped abrasive composite structures includes preparing a curable abrasive composite layer comprising abrasive particles, precursor polymer subunits and optional additives; providing a production tool having a front surface; introducing the curable abrasive composite layer into the cavities of a production tool having a plurality of cavities; introducing a backing or previously cured abrasive composite layer of an abrasive article to the curable abrasive composite layer; and curing the curable abrasive composite layer before the article departs from the cavities of the production tool to form a cured abrasive composite layer comprising abrasive composite structures. The curable abrasive composite is applied to the production tool so that the thickness of the curable abrasive composite layer is less than or equal to its practical thickness limit.

An abrasive composite layer that is substantially free of a plurality of precisely shaped abrasive composite structures is made by placing a curable abrasive composite layer on a backing, or previously cured abrasive composite layers, independently of a production tool, and curing the abrasive composite layer to form a cured abrasive composite layer. The curable abrasive composite layer is applied to a surface so that the thickness of the abrasive composite layer is less than or equal to its practical thickness limit. Additional abrasive composite layers may be added to an abrasive article by repeating the above steps.

The curable abrasive composite layer is made by combining together by any suitable mixing technique the precursor polymer subunits, the abrasive particles and the optional additives. Examples of mixing techniques include low shear and high shear mixing, with high shear mixing being preferred. Ultrasonic energy may also be utilized in combination with the mixing step to lower the curable abrasive composite viscosity (the viscosity being important in the manufacture of the abrasive article) and/or affect the rheology of the resulting curable abrasive composite layer. Alternatively, the curable abrasive composite layer may be heated in the range of 30 to 70° C., microfluidized or ball milled in order to mix the curable abrasive composite.

Typically, the abrasive particles are gradually added into the precursor polymer subunits. It is preferred that the curable abrasive composite layer be a homogeneous mixture of precursor polymer subunits, abrasive particles and optional additives. If necessary, water and/or solvent is added to lower the viscosity. The formation of air bubbles may be minimized by pulling a vacuum either during or after the mixing step.

The coating station can be any conventional coating means such as drop die coater, knife coater, curtain coater, vacuum die coater or a die coater. A preferred coating technique is a vacuum fluid bearing die reported in U.S. Pat. Nos. 3,594,865; 4,959,265 (Wood); and U.S. Pat. No. 5,077,870 (Mellbye, et al.), which are incorporated herein by reference. During coating, the formation of air bubbles is preferably minimized.

After the production tool is coated, the backing, or previously cured abrasive composite layer of an abrasive article, and the next layer of curable abrasive composite is brought into contact by any means such that the next layer of curable abrasive composite wets a surface of the backing or previously cured abrasive composite layer. The curable abrasive composite layer is brought into contact with the backing or the previously cured abrasive composite layer by contacting the nip roll which forces the resulting construction together. The nip roll may be made from any material; however, the nip roll is preferably made from a structural material such as metal, metal alloys, rubber or ceramics. The hardness of the nip roll may vary from about 30 to 120 durometer, preferably about 60 to 100 durometer, and more preferably about 90 durometer.

Next, energy is transmitted into the curable abrasive composite layer by an energy source to at least partially cure the precursor polymer subunits. The selection of the energy source will depend in part upon the chemistry of the precursor polymer subunits, the type of production tool as well as other processing conditions. The energy source should not appreciably degrade the production tool or backing. Partial cure of the precursor polymer subunits means that the precursor polymer subunits is polymerized to such a state that the curable abrasive composite layer does not flow when inverted in the production tool. If needed, the precursor polymer subunits may be fully cured after it is removed from the production tool using conventional energy sources.

After at least partial cure of the precursor polymer subunits, the production tool and abrasive article are separated. If the precursor polymer subunits are not essentially fully cured, the precursor polymer subunits can then be essentially fully cured by either time and/or exposure to an energy source. Finally, the production tool is rewound on a mandrel so that the production tool can be reused again and the fixed abrasive article is wound on another mandrel.

In another variation of this first method, the curable abrasive composite layer is coated onto the backing and not into the cavities of the production tool. The curable abrasive composite layer coated backing is then brought into contact with the production tool such that the slurry flows into the cavities of the production tool. The remaining steps to make the abrasive article are the same as detailed above.

It is preferred that the precursor polymer subunits are cured by radiation energy. The radiation energy may be transmitted through the backing or through the production tool. The backing or production tool should not appreciably absorb the radiation energy. Additionally, the radiation energy source should not appreciably degrade the backing or production tool. For instance, ultraviolet light can be transmitted through a polyester backing. Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light may be transmitted through the production tool and into the slurry. For thermoplastic based production tools, the operating conditions for making the fixed abrasive article should be set such that excessive heat is not generated. If excessive heat is generated, this may distort or melt the thermoplastic tooling.

The energy source may be a source of thermal energy or radiation energy, such as electron beam, ultraviolet light, or visible light. The amount of energy required depends on the chemical nature of the reactive groups in the precursor polymer subunits, as well as upon the thickness and density of the binder slurry. For thermal energy, an oven temperature of from about 50° C. to about 250° C. and a duration of from about 15 minutes to about 16 hours are generally sufficient. Electron beam radiation or ionizing radiation may be used at an energy level of about 0.1 to about 10 Mrad, preferably at an energy level of about 1 to about 10 Mrad. Ultraviolet radiation includes radiation having a wavelength within a range of about 200 to about 400 nanometers, preferably within a range of about 250 to 400 nanometers. Visible radiation includes radiation having a wavelength within a range of about 400 to about 800 nanometers, preferably in a range of about 400 to about 550 nanometers.

The resulting cured abrasive composite layer will have the inverse pattern of the production tool. By at least partially curing or curing on the production tool, the abrasive composite layer has a precise and predetermined pattern.

There are many methods for making abrasive composites having irregularly shaped abrasive composites. While being irregularly shaped, these abrasive composites may nonetheless be set out in a predetermined pattern, in that the location of the composites is predetermined. In one method, curable abrasive composite is coated so that the thickness of the abrasive composite layer is within the practical thickness limits of the composite, into cavities of a production tool to generate the abrasive composites. The production tool may be the same production tool as described above in the case of precisely shaped composites. However, the curable abrasive composite layer is removed from the production tool before the precursor polymer subunits is cured sufficiently for it to substantially retain its shape upon removal from the production tool. Subsequent to this, the precursor polymer subunits are cured. Since the precursor polymer subunits are not cured while in the cavities of the production tool, this results in the curable abrasive composite layer flowing and distorting the abrasive composite shape.

In another method of making irregularly shaped composites, the curable abrasive composite can be coated onto the surface of a rotogravure roll. The backing comes into contact with the rotogravure roll and the curable abrasive composite wets the backing. The rotogravure roll then imparts a pattern or texture into the curable abrasive composite. Next, the slurry/backing combination is removed from the rotogravure roll and the resulting construction is exposed to conditions to cure the precursor polymer subunits such that an abrasive composite is formed. A variation of this process is to coat the curable abrasive composite onto the backing and bring the backing into contact with the rotogravure roll.

The rotogravure roll may impart desired patterns such as a hexagonal array, ridges, lattices, spheres, pyramids, truncated pyramids, cones, cubes, blocks, or rods. The rotogravure roll may also impart a pattern such that there is a land area between adjacent abrasive composites. This land area can comprise a mixture of abrasive particles and binder. Alternatively, the rotogravure roll can impart a pattern such that the backing is exposed between adjacent abrasive composite shapes. Similarly, the rotogravure roll can impart a pattern such that there is a mixture of abrasive composite shapes.

Another method is to spray or coat the curable abrasive composite layer through a screen to generate a pattern and the abrasive composites. Then the precursor polymer subunits are cured to form the abrasive composite structures. The screen can impart any desired pattern such as a hexagonal array, ridges, lattices, spheres, pyramids, truncated pyramids, cones, cubes, blocks, or rods. The screen may also impart a pattern such that there is a land area between adjacent abrasive composite structures. This land area can comprise a mixture of abrasive particles and binder. Alternatively, the screen may impart a pattern such that the backing is exposed between adjacent abrasive composite structures. Similarly, the screen may impart a pattern such that there is a mixture of abrasive composite shapes. This process is reported in U.S. Pat. No. 3,605,349 (Anthon), incorporated herein by reference.

Embossed abrasive foam material made by the present invention may be converted into any of various shapes such as sheets, belts or discs. Embossed abrasive foam discs for surface finishing applications are particularly useful articles made by the present invention. Such discs may be used with a sanding device such as a dual action sander, for example, a dual action sander is that sold by Dynabrade Inc. of Clarence, N.Y. under the trade designation "DYNORBITAL" sander model number 56964. Sanders typically require a support pad having a surface to which the abrasive disc will be mounted. It is fairly commonplace to put a coating of a pressure sensitive adhesive (PSA) composition either on the non-abrasive side of the abrasive disc or on the support pad of the sander. Other mechanical attachment systems are known. For example, the backside of the abrasive article may contain a loop substrate. The purpose of the loop substrate is to provide a means for an abrasive product such as a disc to be securely engaged with hooks on a support pad. Moreover, a sheet which includes erect filament stems which have had their distal ends flattened may also be employed as an engagement device for engagement with a loop substrate. The loop substrate may either be applied to the backside of the abrasive sheet material or to the support to which it will be attached, with the other side being the engaging member, i.e., a sheet which includes a multiplicity of hooks or stems with flattened distal ends.

Test Procedures

The following test procedures were used to evaluate resin compositions and coated abrasive articles of the present invention.

Wet SCHIEFER Test

Abrasive coatings were laminated to a sheet-like backing bearing flattened engaging projections available from Minnesota Mining and Manufacturing Company (3M) under the trade designation HOOK-IT II™ backing and converted into 10.16 cm (4-inch) discs. The back-up pad was secured to the driven plate of a SCHIEFER Abrasion Tester, available from Frazier Precision Company, Gaithersburg, Md., which had been plumbed for wet testing. Disc shaped acrylic plastic workpieces, 10.16 cm (4-inch) outside diameter by 1.27 cm (0.5-inch) thick, available under the trade designation "POLYCAST" acrylic plastic were obtained from Sielye Plastics (Bloomington, Minn.). The water flow rate was set to 60 grams per minute. A 454 grams (one-pound) weight was placed on the abrasion tester weight platform and the mounted abrasive specimen lowered onto the workpiece and the machine turned on. The machine was set to run for 90 cycles in 30 cycle intervals. Surface finish values $R_z$ were measured at four locations on the workpiece for each 30 cycle interval, with each test sample run in triplicate.

Panel Test 15.2 cm (6-inch) diameter circular specimens were cut from the abrasive test material and attached to a DYNABRADE model 56964 fine finish sander, available from Dynabrade Co., Clarence, N.Y. Abrasion tests were run for a total of one minute, in 10, 20 and 30 second intervals over three adjacent sections of the test panel, at an air pressure of 344 kPa (50 psi). The test panels were black base coat/clear coat painted cold rolled steel panels (E-coat: ED5000; Primer: 764–204; Base coat: 542AB921; Clear coat: RK8010A), obtained from ACT Laboratories, Inc., Hillsdale, Mich. Surface finish values $R_z$ were measured at five points on each test panel section, with each test sample run in triplicate.

Surface Finish

Rz is the average individual roughness depths of a measuring length, where an individual roughness depth is the vertical distance between the highest point and the lowest point. The surface finish of abraded workpieces by the Wet SCHIEFER Test and Panel Test were measured using a profilometer under the trade designation "PERTHOMETER MODEL M4P," from Marh Corporation, Cincinnati, Ohio.

EXAMPLES

The following abbreviations are used in the examples. All parts, percentages and ratios in the examples are by weight unless stated otherwise:

| | |
|---|---|
| A-174 | γ-methacryloxypropyltrimethoxy silane, trade designation "SILQUEST A-174," available Crompton Corp., Friendly, WV. |
| AMOX | di-t-amyloxalate |
| CHDM | CHDM is the trade designation for cyclohexanedimethanol, available from Eastman Chemical Company, Kingsport, CT. |
| COM | η-[xylenes (mixed isomers)]-η-cyclopentadienyliron(II)-hexafluoroantimonate. |
| DAROCUR 1173 | 2-hydroxy-2-methylpropiophenone, trade designation "DAROCUR 1173", available from Ciba Specialty Chemicals, Tarrytown, NY. |
| EPON 828 | a bisphenol-A epoxy resin trade, designation "EPON 828," having an epoxy equivalent wt. of 185–192, available from Shell Chemical, Houston, TX. |
| EPON 1001F | a bisphenol-A epichlorohydrin based epoxy resin, trade designation "EPON 10D1F," having an epoxy equivalent wt. of 525–550, available from Shell Chemical, Houston, TX. |
| ERL 4221 | is a trade designation for 3,4-epoxy cyclohexyl methyl-3,4-epoxy cyclohexyl carboxylate) obtained from Union Carbide Corp., currently commercially available from Dow Chemical Co. (Midland, MI). |

-continued

| | |
|---|---|
| GC2500 | green silicon carbide mineral, grade JIS2500, available from Fujimi Corp., Elmhurst, IL. |
| GC3000 | green silicon carbide mineral, grade JIS3000, available from Fujimi Corp., Elmhurst, IL. |
| IRGACURE 651 | 2,2-dimethoxy-1,2-diphenyl-1-ethanone, trade designation "IRGACURE 651," available from Ciba Geigy Company, Ardsley, NY. |
| P400 FSX | aluminum oxide, trade designation ALUDOR BFRPL, commercially available from Treibacher Chemische Werke AG, Villach, Austria. |
| PD9000 | anionic polyester dispersant, trade designation "ZEPHRYM PD 9000," available from Uniqema, Wilmington, DE. |
| S-1227 | a high molecular weight polyester under the trade designation "DYNAPOL S-1227", available from Creanova, Piscataway, NJ. |
| SR339 | SR339 is the trade designation for 2-phenoxyethyl acrylate, available from Sartomer, Inc., Exton, PA. |
| TMPTA | TMPTA is trimethylolpropane triacrylate resin, trade designation "SR351", available from Sartomer, Inc., Exton, PA. |
| TPO-L | phosphine oxide, trade designation "LUCIRIN TPO-L," available from BASF Chemicals, Ludwigshafen, Germany. |
| UVI-6974 | UVI-6974 is the trade designation for triaryl sulfonium hexafluoroantimonate, 50% in propylene carbonate, available from Union Carbide Corp. Hahnville, LA. |

Example 1

Pre-mix #1: 33.6 parts SR339 was mixed by hand with 50.6 parts TMPTA, into which 8 parts PD 9000 was added and held at 60° C. until dissolved. The solution was cooled to room temperature. To this was added 2.8 parts TPO-L and 5 parts A-174 and the mixture again stirred until homogeneous.

Slurry #1: 61.5 parts GC2500 was incorporated into 38.5 parts of pre-mix #1 using the DISPERSATOR mixer from Premier Mill Corp., Reading, Pa.

The abrasive slurry was then applied, via hand spread, to a polypropylene microreplicated tooling made by use of a master roll depicted in FIGS. 5 and 6 wherein: s=55 μm; t=250 μm; w=99.53°; x=54.84 μm; y=55 μm; z=53.00°. The abrasive slurry filled tooling was then laminated face down onto 60 cm×30.5 cm polyethylene foam tape available from Minnesota Mining and Manufacturing Company (3M) under the trade designation 3M 4496W by passing the foam tape through a set of rubber nip rolls at 26 cm/min and a nip pressure of 275 kPa (40 psi). The slurry was then cured by passing twice through a UV processor, available from American Ultraviolet Company, Murray Hill, N.J., using two V-bulbs in sequence operating at 157.5 watts/cm (400 W/inch) and a web speed of 9.1 m/min. On the first pass a 6 mm quartz plate was placed over the laminate in order to maintain pressure on the laminate. The tooling was then separated from the backing to reveal a cured 3-dimensional abrasive coating on top of the polyethylene foam backing. Several 30.5 cm×35 cm sheets of the 3-dimensional abrasive on polyethylene foam were thermally embossed by conveying the foam through a set of nip rolls as depicted in FIG. 7 at a speed of 61 cm/minute and 70 N/cm of web width One of the nip rolls was an unheated, smooth steel roll. The second roll was heated to 121° C. and was patterned (as depicted in FIG. 7), with cross-web, linear grooves resulting in 3 bond points per 2.54 cm. In order to emboss an intersecting network of grooves into the foam abrasive, the embossed abrasive was rotated 90° and sent through the nip rolls a second time. In this way, linear grooves were embossed into the abrasive in two perpendicular directions.

Example 2

Polyurethane ether foam, R600U-125 (available from Illbruck, Minneapolis, Minn.) was spray-coated with water-based latex Hycar 2679 (available from BF Goodrich, Cleveland, Ohio), to achieve a dry coat weight of 8.6 grams/1000 $cm^2$. Slurry #2 was prepared by incorporating 61.5 parts GC3000 into 38.5 parts of pre-mix #1 using the DISPERSATOR mixer from Premier Mill Corp., Reading, Pa. A structured abrasive coating was applied to the resulting foam by first knife-coating slurry #2 onto a polypropylene tool having a small-feature as depicted in FIGS. 6 and 7 wherein: s=55 μm; t=250 μm; w=99.53°; x=54.841 μm, y=55 μm; z=53.00°. The coated tool was then laminated to the latex-coated foam and given a single pass in the UV processor using a D-bulb at 236W/cm (600W/inch) exposure, at a web speed of 9.1 m/min (30 ft/min) and a nip pressure of 344 kPa (50 psi), after which the tooling was removed. Sheets of the 3-dimensional abrasive on polyurethane ether foam were thermally embossed as described in Example 1. However, the temperature of the patterned roll was 204° C. and the line speed was 30 cm/minute.

Example 3

A make resin was prepared as follows: EPON 1001F pellets (25%) and DYNAPOL S-1227 pellets (28%) were compounded with a premix. The premix contains the following: EPON 828 resin (34.5%), IRGACURE 651 (1%), CHDM (2.8%), TMPTA (7.5%), AMOX (0.6%) and COM (0.6%). The materials (Epon 1001F, Dynapol S1227, and the premix) were combined in a twin-screw extruder.

Sheets of dual-sided polyethylene foam tape (4496W available from 3M Company, St. Paul, Minn.) 25.4 cm wide by 61 cm long by 1.6 mm thick were laminated on a single side to 267 mm wide JE weight rayon cloth (available from Milliken, Spartanburg, S.C.). The make resin was extrusion coated at 105° C. and a rate of 20 grams/$m^2$ to one surface of the resulting foam/cloth composite and partially cured by passing once through a UV PROCESSOR, trade designation "EPIQ 6000", available from Fusion Systems Corp., Rockville, Md., with a FUSION V bulb at 0.9J/$cm^2$ and 30 m/min. P400 FSX aluminum oxide was then applied electrostatically at 36 g/$m^2$ and further cured at a temperature range of 77–122° C.

A size coat was prepared as follows: TMPTA (28.8%), ERL 4221 (67.2%), UVI-6974 (3%) and DAROCUR 1173 (1.0%) were added. The size was roll coated at 25 g/$m^2$ and cured by passing through the UV processor at 30 m/min using a FUSION D bulb at 0.9J/$cm^2$ and then thermally cured at a temperature range of 110–120° C.

Individual 25 cm×35 cm sheets of the resulting coated abrasive on polyethylene foam were thermally embossed as described in Example 1. However, the temperature of the patterned roll was 121° C.

The parent, unembossed abrasives and the subsequent embossed abrasives from Examples 1 and 2 were tested using both the Wet SCHIEFER and Panel tests. Comparative Sample 1 was a commercially available coated abrasive product identified under the trade designation TRIZACT™ HOOKIT™ II Foam disc, Grade P3000, PN 02075, available from 3M Company, St. Paul, Minn.

The Results are listed in Table 1 and Table 2, respectively.

TABLE 1

| Wet SCHIEFER Test | | | | |
|---|---|---|---|---|
| Sample | $R_z$ - Initial μm (μ-inches) | $R_z$ @ 30 cycles μm (μ-inches) | $R_z$ @ 60 cycles μm (μ-inches) | $R_z$ @ 90 cycles μm (μ-inches) |
| Comparative Sample 1 | 1.74 (68.5) | 0.76 (30.0) | 0.66 (25.8) | 0.67 (26.4) |
| Example 1 Unembossed abrasive | 1.67 (65.8) | 0.80 (31.6) | 0.52 (20.7) | 0.40 (15.6) |
| Embossed Abrasive | 1.70 (67.0) | 0.76 (29.8) | 0.62 (24.6) | 0.60 (23.7) |
| Example 2 Unembossed abrasive | 1.70 (67.3) | 0.76 (30.0) | 0.48 (19.0) | 0.39 (15.5) |
| Example 2 Embossed abrasive | 1.67 (65.6) | 0.82 (32.3) | 0.53 (20.7) | 0.45 (17.8) |

TABLE 2

| Panel Test | | | | | |
|---|---|---|---|---|---|
| Example | Stiction | $R_z$ - Initial μm (μ-inches) | $R_z$ @ 10 secs. μm (μ-inches) | $R_z$ @ 30 secs. μm (μ-inches) | $R_z$ @ 60 secs. μm (μ-inches) |
| Comparative Sample 1 | No | 1.70 (67.1) | 0.69 (27.3) | 0.56 (22.1) | 0.56 (22.1) |
| Example 1 Unembossed Abrasive | Yes | 1.66 (65.4) | 0.41 (16.1) | 0.44 (17.3) | 0.44 (17.5) |
| Example 1 Embossed Abrasive | No | 1.70 (66.9) | 0.65 (25.7) | 0.56 (22.2) | 0.55 (21.7) |
| Example 2 Unembossed Abrasive | No | 1.71 (67.4) | 0.68 (26.8) | 0.55 (21.5) | 0.55 (21.7) |
| Example 2 Embossed Abrasive | No | 1.73 (68.0) | 0.66 (26.1) | 0.56 (22.0) | 0.57 (22.3) |

The results shown in Table 2 illustrate that stiction occurs during wet sanding when the 3-dimensional abrasive article does not have a means to transport fluid, either through the foraminous body of the abrasive or through structures designed into the abrasive directly. The results in Table 1 may also be affected by stiction problems, however, since the SCHIEFER test is conducted by machine, it is difficult to elucidate whether the phenomenon is occurring. While stiction essentially renders an abrasive unusable for wet sanding, it also tends to draw the abrasive more tightly to the workpiece, thereby increasing the pressure of the abrasive on the workpiece and resulting in more abrasive action. This is evident from the surface-finish numbers in Tables 1 & 2.

The examples also show that a non-foraminous, 3-dimensional abrasive article coated onto a low-cost, closed-cell polyethylene foam tape may be designed, for example, by embossing, to eliminate stiction problems and function essentially the same as a more-costly, foraminous, 3-dimensional abrasive article. The approach of embossing a non-foraminous, 3-dimensional abrasive article on a closed-cell foam backing provides a lower-cost alternative to a foraminous, 3-dimensional abrasive article on an open-cell foam backing. Additionally, it is shown that abrasives on polyurethane ether foam can also be thermally embossed, as illustrated by Example 2. Example 3 demonstrates that conventional abrasives on foam backings can also be readily embossed.

The present invention has now been described with reference to several embodiments thereof The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A method of making an embossed abrasive article comprising:

a. providing a sheet foam backing having a first surface and an opposite second surface;

b. providing an abrasive coating comprising abrasive particles and binder over said first surface to provide an abrasive article; and c. applying, under pressures, a patterned embossing tool having an embossing surface including a least a pattern of raised areas to the abrasive coating of the abrasive article to provide an embossed pattern at least including depressed areas in said wherein the depressed areas extend into the foam backing, and wherein the depressed areas correspond to the raised areas of said embossing surface.

2. The method or claim 1 wherein said embossing surface also includes depressed areas and said embossed pattern also includes raised areas corresponding to said depressed areas of said embossing surface.

3. The method of claim 1 wherein said pattern comprises a uniform pattern.

4. The method of claim 1 wherein said pattern comprises a random pattern.

5. The method of claim 1 wherein said abrasive coating is provided by applying a flowable curable binder make coating to said first surface, at least partially embedding therein said abrasive particles and at least partially curing said make coating.

6. The method of claim 5 further comprising applying said over said make coating and said abrasive particles, a flowable binder size coating and curing said size coating.

7. The method of claim 6 wherein at least one of said binder make coating and said binder size coating comprises a radiation-curable binder and said curing is by radiation curing.

8. The method of claim 1 wherein said abrasive coating is provided by applying a mixture of flowable curable binder and abrasive particles to said first surface and curing said flowable curable binder to provide said abrasive coating.

9. The method of claim 8 wherein said flowable curable binder comprises a radiation-curable binder and said curing is by radiation curing.

10. The method of claim 8 wherein, after said coating mixture of flowable curable binder and abrasive particles are applied to said first surface and before curing, said coating is contacted with a device having a surface which imparts a pattern to the abrasive coating to provide raised areas and depressed areas in the abrasive coating but not in the foam backing and at least partially curing the patterned abrasive coating.

11. The method of claim 1 wherein said patterned embossing tool is an embossing roll.

12. The method of claim 1 wherein said depressed areas extend to a depth of at least 200 $\mu$m into the roam backing.

13. The method of claim 1 wherein said foam backing has a thickness of at least about 0.2 millimeter.

14. The method of claim 1 wherein said foam backing has a thickness in the range of about 1 millimeter to about 6 millimeter.

15. The method of claim 1 wherein said foam backing is an open cell foam.

16. The method of claim 1 wherein said foam backing is a closed cell foam.

17. The method of claim 1 wherein said abrasive particles have an average particle size in the range of 0.1 to 60 micrometers.

18. The method of claim 17 wherein said average particle size is in the range of 1 to 30 micrometers.

19. The method of claim 1 wherein the depressed areas extend into said foam backing at least 200 micrometers.

20. The method of claim 19 wherein the depressed areas extend into said foam backing at least 500 micrometers.

21. The method of claim 1 wherein said foam backing comprises a polyethylene foam backing.

22. The method of claim 1 wherein said foam backing comprises a polyurethane foam backing.

23. The method of claim 1 wherein said embossing tool is heated.

24. The method of claim 23 wherein said embossing tools is heated to at least 30° C.

25. The method of claim 23 wherein said embossing tool is heated at a temperature in the range of 80° C. to 210° C.

26. The method of claim 1 wherein said embossing tool is applied at a pressure in the range of 1.5 to 200 N/cm of web width.

* * * * *

UNITED STATES PATENT AND TRADEMARK OFFICE

CERTIFICATE OF CORRECTION

PATENT NO. : 6,949,128 B2
DATED : September 27, 2005
INVENTOR(S) : Annen, Michael J.

It is certified that error appears in the above-identified patent and that said Letters Patent is hereby corrected as shown below:

Column 8,
Line 58, delete “thc” and insert -- the --.

Column 10,
Line 57, after “thereof” insert -- . --.

Column 11,
Line 15, delete “isobomyl” and insert -- isobornyl --.

Column 13,
Line 5, after “thereof” insert -- . --.
Lines 5-32, delete “Epoxy resins useful as binders have an...under the trade designations “DEN 431” and “DEN 438”).” and insert the same on line 6 as a new paragraph.

Column 14,
Line 40, delete “photoinitiator” and insert -- photoinitiators --.
Line 43, delete “Tarrytown. N.Y.,” and insert -- Tarrytown, N.Y. --.
Line 47, insert -- ( -- before “Krech”.

Column 16,
Line 16, delete “round” and insert -- found --.
Line 22, delete “No.,” and insert -- No. -- and delete “chasley” and insert -- Chesley --.

Column 17,
Line 33, after “thereof” insert -- . --.

Column 20,
Line 19, after “thereof” insert -- . --.
Line 23, delete “an” and insert -- An --.

Column 26,
Line 11, delete “54.841” and insert -- 54.84 --.

UNITED STATES PATENT AND TRADEMARK OFFICE

CERTIFICATE OF CORRECTION

PATENT NO. : 6,949,128 B2
DATED : September 27, 2005
INVENTOR(S) : Annen, Michael J.

It is certified that error appears in the above-identified patent and that said Letters Patent is hereby corrected as shown below:

Column 28,
Line 2, after "thereof" insert -- . --.
Line 21, delete "pressures" and insert -- pressure --.
Line 22, delete "a least" and insert -- at least --.
Line 46, after "said" insert -- abrasive coating and said foam backing to provide an embossed abrasive article, --.
Line 49, delete "or" and insert -- of --.

Column 29,
Line 19, delete "roam" and insert -- foam --.

Signed and Sealed this

Twenty-first Day of February, 2006

JON W. DUDAS
*Director of the United States Patent and Trademark Office*